US006500525B1

(12) United States Patent
Ogino et al.

(10) Patent No.: US 6,500,525 B1
(45) **Date of Patent: *Dec. 31, 2002**

(54) RECORDING MEDIUM, IMAGE FORMATION METHOD THEREBY, AND PRODUCTION METHOD THEREOF

(75) Inventors: Hiroyuki Ogino, Kawasaki (JP); Tsuyoshi Santo, Yokohama (JP); Yuji Kondo, Machida (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/328,803

(22) Filed: Jun. 9, 1999

(30) Foreign Application Priority Data

Jun. 12, 1998 (JP) ..... 10-165346

(51) Int. Cl.[7] ..... B41M 5/00

(52) U.S. Cl. ..... 428/195; 347/105; 427/146

(58) Field of Search ..... 428/195, 328, 428/329; 347/105; 427/146

(56) References Cited

U.S. PATENT DOCUMENTS

| | | | | |
|---|---|---|---|---|
| 3,983,291 | A | 9/1976 | Chang | 428/290 |
| 4,202,870 | A | 5/1980 | Weber et al. | 423/630 |
| 4,242,271 | A | 12/1980 | Weber et al. | 260/448 AD |
| 4,879,166 | A | 11/1989 | Misuda et al. | 428/212 |
| 5,104,730 | A | 4/1992 | Misuda et al. | 428/304.4 |
| 5,679,451 | A | 10/1997 | Kondo et al. | 428/304.4 |
| 5,846,647 | A | 12/1998 | Yoshino et al. | 428/328 |
| 5,965,252 | A | 10/1999 | Santo et al. | 428/329 |

FOREIGN PATENT DOCUMENTS

| | | |
|---|---|---|
| EP | 0 741 045 | 11/1996 |
| EP | 0 803 375 A1 | 10/1997 |
| JP | 54-59936 | 5/1979 |
| JP | 57-89954 | 6/1982 |
| JP | 60-224578 | 11/1985 |
| JP | 61-12388 | 1/1986 |
| JP | 2-276670 | 11/1990 |
| JP | 4-37576 | 2/1992 |
| JP | 5-32037 | 2/1993 |
| JP | 6-227114 | 8/1994 |
| JP | 7-76161 | 3/1995 |
| JP | 7-276784 | 10/1995 |
| JP | 9-76628 | 3/1997 |
| JP | 2714350 B2 | 2/1998 |
| JP | 2714351 B2 | 2/1998 |
| JP | 2714352 B2 | 2/1998 |
| JP | 10-94754 | 4/1998 |

*Primary Examiner*—Pamela R. Schwartz
(74) *Attorney, Agent, or Firm*—Fitzpatrick, Cella, Harper & Scinto

(57) ABSTRACT

The present invention provides a recording medium having an ink receiving layer on its base material, in which the ink receiving layer is obtained by coating the base material with dispersed liquid containing aluminum hydrate, a coupling agent, and a resin emulsion having hydrolyzable groups expressed by the following general formula (1):

$$-MR_n(OR')_{3-n} \quad (1)$$

where R and R' represent hydrogen or alkyl groups, which may be either identical or different; n represents an integer from 0 to 2; and M represents Si, Ti, or Zr.

In addition, the invention provides an image formation method for forming an image by ejecting ink from micropores to attach the ink on the recording medium, and also provides a production method for the recording medium.

11 Claims, 1 Drawing Sheet

FIGURE
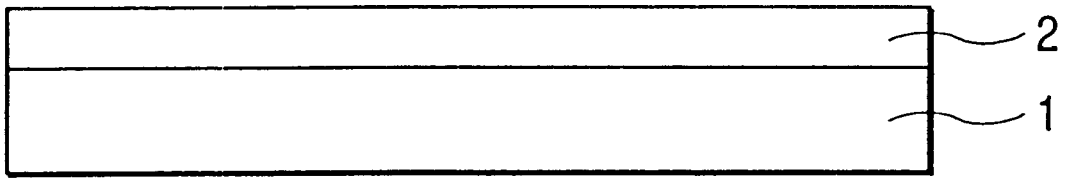

RECORDING MEDIUM, IMAGE FORMATION METHOD THEREBY, AND PRODUCTION METHOD THEREOF

BACKGROUND OF THE INVENTION

1. Field of the Invention

The present invention relates to a recording medium suitable to ink jet recording.

Furthermore, the present invention relates to a production method of the recording medium and an image formation method using the recording medium.

2. Related Background Art

Recently, an ink jet recording system, in which print images, characters, and the like are recorded by ejecting micro drops of ink in accordance with various operating principles and applying the micro drops to a recording medium such as paper, has rapidly become widespread in various applications as well as information-processing equipment as recording equipment for various images. It is because the ink jet recording system has advantages such as high-speed and low noise, easy multi-color printing, large flexibility in printing pattern, and unnecessity of development and fixing. Furthermore, it is also possible to obtain images formed by a multi-color ink jet recording system, which are not inferior to multi-color prints by a plate-making system and photoprints by a color photographic system. Moreover, if the number of printing media is small, the prints by the ink jet recording system is less expensive than the ordinary multi-color prints and photoprints, and hence have been widely applied even to the field of a fill-color image recording. Although ink jet recording apparatuses and printing methods have been improved with the improvement in recording characteristics in terms of sensitivity such as high-speed recording, high-resolution recording, and full-color recording, printing media also have been required to have advanced characteristics.

Recently, printing media having a coating layer made of aluminum hydrate with boehmite structure have been proposed. For example, they are disclosed in U.S. Pat. Nos. 4879166 and 5104730 and Japanese Patent Application Laid-Open Nos. 2-276670, 4-37576, and 5-32037.

A recording medium with this aluminum hydrate has such advantages as firm fixing of dyes in ink due to positive charges in the aluminum hydrate, good transparency of an ink receiving layer containing the aluminum hydrate and thick print density, and an image having good color development can be obtained. In addition, there are no problems such as browning of black ink and degradation of light resistance, which are heretofore caused by silica compounds conventionally used, and this medium is superior to a conventional recording medium in terms of image quality, in particular, that in an full-color image, gloss, and applicability to an OHP sheet.

Nevertheless, in order to fully make use of the advantages of this aluminum hydrate in a recording medium, the following improvement is required.

Although a recording medium with aluminum hydrate has excellent ink absorptivity due to capillary phenomenon, the recording medium is significantly affected by environmental humidity. Therefore, this recording medium has a problem that the ink absorptivity is remarkably lowered under high-humidity environment because it absorbs environmental moisture.

In Japanese Patent Application Laid-Open No. 7-76161, use of boric acid is described. Nevertheless, this method causes a problem with long-term stability of coating liquid, and further requires a thermal curing process for sufficient reaction, and hence this leads to cost increase.

In addition, in Japanese Patent Application Laid-Open No. 7-276784, it is described to form firm bonding with a pigment (silica) by performing silanol-modification of a binder. However, according to the present inventors' investigation, it has been shown that if the aluminum hydrate having the excellent characteristics described above is used as a pigment, the aluminum hydrate can not exhibit sufficient effects and has a problem with ink absorptivity after a storage especially under a high-temperature and high-humidity environment.

Furthermore, in Japanese Patent Application Laid-Open No. 9-76628, a combination of aluminum hydrate and a coupling agent is described.

On the other hand, it is described in Japanese Patent Application Laid-Open Nos. 6-227114 and 10-094754, European Patent Application Laid-Open No. 803375A1 or the like to use a resin binder in emulsion form. However, if the binder is used in emulsion form, the ink absorptivity certainly increases more than that of a water-soluble binder, but binding strength with the aluminum hydrate is remarkably lowered. Therefore, ordinary waterproof as well as the ink absorptivity after storage under a high-temperature and high-humidity environment degrades.

SUMMARY OF THE INVENTION

A object of the present invention is to provide an recording medium having excellent shelf life and ink absorptivity under a high-humidity environment, wherein its ink receiving layer has transparency, image density is thick, hue is clear, resolution of an image is good, and to provide image formation method using the recording medium.

In addition, another object of the present invention is to provide a production method of such a recording medium.

The present inventor et al. earnestly performed investigation so as to solve the above problems, and in consequence, completed the present invention.

Thus, the present invention provides a recording medium having an ink receiving layer on its base material, wherein the ink receiving layer is obtained by coating the base material withdispered liquid containing aluminum hydrate, a coupling agent, and resin emulsion having hydrolyzable groups expressed by the following general formula (1):

$$-MR_n(OR')_{3-n} \quad (1)$$

where R and R' represent hydrogen or alkyl groups, which may be either identical or different; n represents an integer from 0 to 2; and M represents Si, Ti, or Zr.

In addition, the present invention provides an image formation method for forming an image with ejecting ink from minute orifices to attach the ink on a recording medium, wherein the recording medium described above is used.

Moreover, the present invention provides a production method of a recording medium that is produced by forming an ink receiving layer on a base material, wherein the ink receiving layer is formed by coating on a base material dispersed liquid containing aluminum hydrate, a coupling agent, and resin emulsion having a hydrolyzable group expressed by the above-described general formula (1) and thereafter drying the recording medium.

BRIEF DESCRIPTION OF THE DRAWING

FIGURE is a schematic diagram showing the configuration of a recording medium of the present invention.

DETAILED DESCRIPTION OF THE PREFERRED EMBODIMENTS

A recording medium of the present invention, as shown in figure, has such configuration that an ink receiving layer 2 is formed on a base material 1.

Aluminum hydrate contained in the ink receiving layer 2 is expressed by the following general formula:

$$Al_2O_{3-n}(OH)_{2n}.mH_2O$$

where n represents any one of integers 0, 1, 2, and 3; m represents a value among 0 to 10, preferably, 0 to 5; m and n do not become zero simultaneously; m can have a value that is not an integer because $mH_2O$ represents a separable water phase in many cases that does not affect the formation of crystal lattices; and m may reach zero if this type of aluminum hydrate is calcined.

Aluminum hydrate preferable to implementation of the present invention is hydrate that having a boehmite structure or being amorphous determined by an X-ray diffraction method, and in particular, it is preferable to use aluminum hydrate described in Japanese Patent Nos. 2714350, 2714351, and 2714352. In particular, it is preferable that the aluminum hydrate has boehmite structure or is an amorphous compound in terms of transparency, color development, and ink absorptivity, and it is preferable that the luminum hydrate is planar aluminum hydrate whose average aspect ratio is 3 to 10.

Although the aluminum hydrate is conditioned on pore property in a production process, it is preferable to use aluminum hydrate, whose pore volume is 0.1 to 1.0 ml/g, in order to obtain a recording medium that can fulfil a BET specific surface area and the pore volume of the ink receiving layer described below.

In addition, it is preferable to use aluminum hydrate having a BET specific surface area of 40 to 500 $m^2/g$.

In the present invention, it can be permissible to mix the following pigment with the aluminum hydrate. Pigments usable to a recording medium of the present invention are, for example, inorganic pigments such as calcium carbonate, kaoline, talc, calcium sulphate, barium sulphate, titania, zinc oxide, zinc carbonate, aluminum silicate, alumina, silicic acid, sodium silicate, magnesium silicate, calcium silicate, and silica; organic pigments such as plastic pigments and urea resin pigments; and pigments in concomitant use of these pigments.

In a recording medium of the present invention, a coupling agent is used for further firmly binding a surface of the aluminum hydrate in the ink receiving layer with a binder resin described later.

The coupling agent in the present invention is used for firmly binding the surface of the aluminum hydrate in the ink receiving layer with the binder resin having a side-chain, which is described later, in the condition of comparatively low temperature and a short time without deteriorating suitability for coating. A coupling agent of any ordinary one of an silane type, a titanate type, an aluminum type, and a zirconium type that are listed in Japanese Patent Application Laid-Open No. 09-076628 is used as the coupling agent. Furthermore, at least two hydrolyzable groups as functional groups are required.

A coupling agent of the silane type is especially preferable among the above coupling agents because it is easy to adjust the reactivity to suitable one at a pH of 3 to 5 where dispersion of the aluminum hydrate is stabilized. For example, in an abrupt reaction, coupling agents are apt to be polymerized with each other and to cause gelation.

Although a dosage of a coupling agent varies dependent on properties of aluminum hydrate and type of the coupling agent, generally the effects of the present invention can be obtained by adopting the dosage within a range of 0.1 to 30% by weight, preferably 0.5 to 20% by weight, further preferably 1 to 10% by weight, to the aluminum hydrate. The most preferable dosage of the coupling agent is such dosage that the ratio of a coated area which has been subject to coupling treatment in the surface area of the aluminum hydrate (coverage of aluminum hydrate) becomes 0.1 to 30%, preferably 0.5 to 20%, further preferably 0.7 to 15%. Further specifically, quantity a (g) in which a monomolecular film of the coupling agent covers 100% of the surface of the raw material powder of the aluminum hydrate is determined dependent on the minimum coating area of the coupling agent and the surface area of the aluminum hydrate and is calculated by the following formula:

$$a\ (g) = (\text{Weight of aluminum hydrate } (g) \times \text{Specific surface area } (m^2/g))/(\text{Minimum Coating area of coupling agent } (m^2/g))$$

Therefore, the preferable dosage of the coupling agent in the present invention is expressed by $0.001a\ (g) \leqq \text{Dosage}\ (g) \leqq 0.3a\ (g)$.

If the ratio of the coated area to the surface area of the aluminum hydrate, which is obtained from the above formula, is less than 0.1%, the binding strength with a resin binder containing a hydrolyzable group described below decreases. On the other hand, if it is more than 30%, the stability and coating performance of dispersed liquid increases, but the ink absorptivity, resolution, and color reproducibility which are fundamental performance of a recording medium decrease.

Coupling reactions on the surface of aluminum hydrate in the present invention are described in detail in catalogues and technical data of coupling agent manufacturers (for example, Nippon Unicar Co., Limited, Toshiba Silicone Co., Limited, Shin-Etsu Silicone Co., Limited, and Ajinomoto Co., Inc.). Their processing methods are generally classified into three methods, that is, a dry method, a wet method, and a spraying method.

In the present invention, the wet method, by which a hydrolysis reaction can be treated in a lump at the time of a coating and drying process and uniform processing can be carried out, is preferable.

In addition, in order to adjust solubility, hydrolyzability, and reactivity of the coupling agent, it can be permissible to add polar organic solvent such as methyl alcohol, ethyl alcohol, isopropyl alcohol (IPA), n-butanol, acetone, trimethylketone (MEK), diacetone alcohol, methyl cellosolve, ethyl cellosolve, dimethyl formamide (DMF), and dimethyl sulfoxide (DMSO), and acid catalyst such as formic acid, acetic acid, nitric acid, and hydrochloric acid to aqueous dispersed liquid containing the aluminum hydrate and coupling agent.

Any resin that can form emulsion and has functions as a binder can be used without any limitation as the resin emulsion containing hydrolyzable groups for forming the ink receiving layer in the present invention. As such resins, for example, an acrylic resin, polyurethane, vinylidene chloride, polyolefin, polyvinyl acetate, styrene-acryl copolymer, ethylene-vinyl acetate copolymer, and polyvinyl butyral resins can be listed, and one, or two or more of these polymers can be used in combination.

Although the molecular weight of the binder is not limited, the molecular weight of 3000 or more is preferable.

In addition, among the binders described above, the polyurethane resin is preferable because it is comparatively easy to introduce hydrolyzable groups described later and its binder fitness is good.

A preferable average particle diameter of the emulsions formed with the binder described above is 20 to 100 nm, further preferably 40 to 100 nm. If the particle diameter is larger than 100 nm, the transparency and gloss decrease. On the contrary, if it is less than 20 nm, the ink absorptivity decreases.

Furthermore, the resin binder used in the present invention has hydrolyzable groups expressed by the following general formula:

$$—MR_n(OR')_{3-n}$$

where M represents Si, Ti, or Zr; R and R' represent hydrogen or alkyl groups, which may be either identical or different; and n represents an integer from 0 to 2.

In the present invention, the hydrolyzable group described above is introduced to form binding of the above-described hydrolyzable group with a coupling agent adsorbed on the surface of the aluminum hydrate. For this reason, at least one hydrolyzable group (OR') serving as a functional group is required. It is preferable that each of the alkyl groups represented by R and R' is that in which the number of carbon atoms is 1 to 5, preferably 1 to 3. As an example, with using polyurethane emulsion having hydrolyzable silicon groups (M is Si), the resin emulsion having the above-described side-chains will be described.

In order to introduce the hydrolyzable silicon groups according to the present invention in the polyurethane resin, it is proper to use a compound containing an active hydrogen group, which can react with at least one isocyanate group, and a hydrolyzable silicon group in a molecule. The silicon group is introduced by urethane bonding, and this bonding, as described later, is formed by the reaction of a compound having at least two active hydrogen groups such as amino groups, hydroxyl groups, and mercapto groups in a molecule (hereinafter, this is described as a compound containing active hydrogen groups); a compound such as aliphatic diisocyanate, alicyclic diisocyanate, and aromatic diisocyanate that has at least two isocyanate groups in a molecule, i.e., trimethylene diisocyanate and tetraethylene diisocyanate (hereinafter, this is described as a compound containing isocyanate groups); and a compound containing at least one active hydrogen group such as a mercapto group, a hydroxyl group, and an amino group in a molecule, which can react with an isocyanate group, and containing a hydrolyzable silicon group ($—Si(OR')_{3-n}$ in the formula (1)) (hereinafter, this is described as a compound containing silicon groups). In the present invention, it is preferable to have a hydrolyzable silicon group in an intermediate part of a molecule constructing a polyurethane resin in terms of capability of increasing the bridged density by hydrolysis with the coupling agent described above. It is possible to form a compound having such structure by using a compound containing silicon groups that contains active hydrogen.

In addition, in order to make the polyurethane emulsion stably exist in an aqueous phase, a resin in which a hydrophilic group is introduced in the polyurethane resin is preferable. In this case, as the hydrophilic groups, for example, a carboxyl group, a sulfonic acid group, a sulfonate group, an epoxy group, and a polyoxyethylene group can be listed.

Furthermore, in order to make the polyurethane emulsion stably exist in an aqueous phase, it is possible to use a surface active agent in combination with the above compound.

The content of the hydrolyzable silicon groups in the polyurethane emulsion can be controlled in terms of the amount of the compound to use having hydrolyzable silicon groups.

For example, in the case when polyurethane polymers each of which has an isocyanate and group are synthesized by reacting the compound having active hydrogen groups to the compound having isocyanate groups and thereafter conducting the reaction with the compound containing hydrolyzable silicon groups, the ratio of the active hydrogen groups in the compound having hydrolyzable silicon groups to the isocyanate groups in the polyurethane prepolymers (rate of silicon added) is preferably 0.05 to 0.8, and further preferably 0.1 to 1.8. If the rate of silicon added is less than 0.05, the quantity of the hydrolyzable silicon groups introduced into a molecule is small, and hence the binding density with the coupling agent adsorbed in the surface of the aluminum hydrate decreases. Hence, the shelf life and ink absorptivity of the ink receiving layer under a high-humidity environment decreases. In addition, if the rate of silicon added is more than 0.8, the viscosity of the coating liquid increases and the storage stability decreases.

In the present invention, it is also possible to use water soluble resins such as polyvinyl alcohol and gelatin besides the resin emulsion having hydrolyzable groups so as to increase mechanical strength and decrease cracking and powdering. At this time, the suitable mixing ratio of the water soluble resin to the resin emulsion (water soluble resin/resin emulsion) is 50% or less by weight of solid components. If it is more than 50%, the ink absorptivity after storage under a high-temperature and high-humidity environment decreases due to the hygroscopicity of the water soluble resin.

The ink absorptivity after storage under a high-temperature and high-humidity environment can be also expressed by the coefficient of moisture absorption of a recording medium, which is calculated by the following formula.

Specifically, a sheet, which has been just prepared, is cut into pieces with predetermined size, and then it is weighed (X g). This recording medium is left under a high-temperature and high-humidity (50° C./80% RH) environment for 10 days. The recording medium is then picked out and left under a ordinary temperature and humidity (23° C./60%) environment for 30 minutes. Thereafter, the recording medium is weighed (Y g), so that the coefficient of moisture absorption of the ink receiving layer is obtained from the following formula:

$$\text{Coefficient of moisture absorption (\%)} = (Y-X)/(X-\text{Weight of base material}) \times 100\ (\%)$$

It is preferable that the coefficient of moisture absorption obtained in this manner is 2.0% or less. If it is more than 2.0%, the shelf life and ink absorptivity under the high-temperature and high-humidity environment decreases.

It is preferable that the ink receiving layer of the recording medium of the present invention is formed to have its total pore volume of 0.1 to 1.0 ml/g. If the pore volume of the ink receiving layer is larger than the above range, cracking and powdering of the ink receiving layer easily arises. If smaller than the above range, ink absorptivity decreases, and in particular, when multi-color printing is conducted, smear of an image easily arises by ink spilling from the ink receiving layer.

In addition, it is preferable that the BET specific surface area of the ink receiving layer is in the range of 40 to 450 $m^2/g$. If it is smaller than this range, the gloss of the ink receiving layer decreases, and an image may seem to be covered with a whitish haze due to the increase of haze. In addition, if it is larger than the above range, cracking of the ink receiving layer easily arises.

It is possible to obtain the above-described BET specific surface area and pore volume using a nitrogen adsorption-desorption method after degassing treatment at 120° C. for 24 hours.

As far as the range of the BET specific surface area and pore volume of the ink receiving layer satisfy the above range, it is possible to arbitrary select the mixing ratio of the aluminum hydrate to the resin emulsion within 1:1 to 30:1, preferably 5:1 to 20:1 by the weight ratio of solid components. If the quantity of the binder is smaller than the above-described range, the mechanical strength of the ink receiving layer is insufficient, and hence cracking and powdering arises in some cases. If it is more than the above-described range, the pore volume becomes small, and hence ink absorptivity decreases.

It is permissible to add a dispersing agent, a thickener, a pH conditioner, a lubricant, a flowability modifier, a surface active agent, an antifoamer, a waterproofing agent, a foam suppressor, a releasing agent, a forming agent, a penetrating agent, a color dye, a fluorescent brightening agent, an ultraviolet absorbing agent, an antioxidant, an antiseptic, and a bacteria proofing agent to the dispersed liquid containing the aluminum hydrate, coupling agent, and resin binder if necessary.

It is possible to arbitrary select and use any one among known materials such as halogenated quaternary ammonium salt and quaternary ammonium salt polymers as the waterproofing agent.

Means, used for usual dispersion, such as a homomixer, a high-speed high-shearing disperser, a ball mill, a sand grinder, an attriter, a colloid mill, an ultrasonic disperser, and a pressure homogenizer is preferably used as the dispersion means.

Paper such as paper properly sized, non-sized paper, and resin-coated paper, a sheet material such as a thermoplastic film, and a cloth can be used as a base material holding the ink receiving layer of the recording medium of the present invention, and hence there is no specific limitation.

In the case of the thermoplastic film, it is also possible to use a transparent film of polyester, polystyrene, polyvinyl chloride, polymethyl methacrylate, cellulose acetate, polyethylene, and polycarbonate, and a sheet thereof that is made opaque by further adding aluminum hydrate and titanium white or forming minute bubbles.

If the resin-coated paper is used as the base material, it is possible to obtain the same touch, stiffness and feeling as a ordinary photoprint, and further, an image on the recording medium of the present invention is considerably similar to that of the ordinary photoprint since the recording medium has rich gloss in the ink receiving layer.

In addition, so as to achieve good adhesion between the base material and ink receiving layer, it is also preferable to perform surface treatment of the base material such as corona treatment and flame treatment and to provide an adhesive layer capable of easily adhering as an under-coated layer. Furthermore, so as to prevent curl, it is also preferable to provide a curl prevention layer such as a resin layer or a pigment layer and/or a writable layer on the back side (the side opposite to the side where the ink receiving layer is provided) or predetermined portion of the base material.

The ink receiving layer is formed with a method comprising the steps of coating on a base material and drying dispersed liquid containing aluminum hydrate and the binder, which are coupling-treated, using a coater. Usable coating methods include a blade coat system, an air knife system, a roll coating system, a brush coating system, a gravure coating system, a kiss coating system, an extrusion system, a slide hopper (slide bead) system, a curtain coating system, a sprayed coating system, and the like. Usable means for drying the dispersed liquid coated include various types of dryers such as hot air dryers, which contain a linear tunnel drier, an arch drier, an air loop drier, and a sine curve air float drier, infrared rays, a heating dryer, and a microwave dryer.

Application quantity of the dispersed liquid is 0.5 to 60 $g/m^2$ in the weight of dry solid matter, further preferably 5 to 45 $g/m^2$. In addition, so as to obtain the good ink absorptivity and resolution, it is required to coat the ink receiving layer in 15 $\mu$m or thicker, preferably 20 $\mu$m or thicker, and particularly 25 $\mu$m or thicker.

The ink receiving layer according to the present invention can have either single-layer structure or multiple-layer structure. As examples of the multiple-layer configuration, Japanese Patent Application Laid-Open Nos. 57-89954, 60-224578, and 61-12388 can be listed. For example, it is possible to provide an ink permeable layer, which is described in the Japanese Patent Application Laid-Open No. 61-12388, on the ink receiving layer of the present invention. In addition, although the ink receiving layer is provided on at least one side of a base material, the ink receiving layers can be provided on both sides of the base material for curl prevention and ink jet recording on both sides.

Ink which can be used in an image formation method of the present invention mainly contains a color material (dye or pigment), a water-soluble organic solvent, and water. In terms of the dye, a water-soluble dye such as a direct dye, an acid dye, a basic dye, a reactive dye, and a food dye is preferable, and any one among them can be used so long as it forms an image fulfilling the required performance such as fixity, chromogenic, visibility, stability, and light resistance, in combination with a recording medium.

The water-soluble dye is used with dissolving it in a solvent generally composed of water, or water and an organic solvent, wherein a mixture of water and various types of water-soluble organic solvents is preferably used for the solvent. It is preferable to condition the mixture so that the moisture content of the ink can be within 20 to 90% by weight, and preferably 60 to 90% by weight.

In addition, it is also possible to add a solubilizing agent for remarkably increasing the solubility of the water-soluble dye to a solvent. Furthermore, for the improvement of characteristics, it is also possible to add an additives such as a viscosity conditioner, a surface active agent, a surface tension conditioner, a pH conditioner, a specific resistance conditioner, and a preservation stabilizer.

An preferable image formation method for performing printing by attaching the ink on the recording medium is an ink jet recording method. Any type of ink jet recording method can be used so long as it can attach ink on a recording medium by effectively ejecting the ink from a nozzle. In particular, an ink jet system, which is described in Japanese Patent Application Laid-Open No. 54-59936, can be effectively used wherein ink is ejected from a nozzle by means of a working force due to a state change caused by the abrupt volume change of ink subjected to a thermal energy action.

Embodiments

Hereinafter, embodiments will be shown for further specific description of the present invention, but the present invention is not limited to these.

(Production of aluminum hydrate)

Aluminum dodeoxide was produced by means of a method described in U.S. Pat. No. 4,242,271. A alumina slurry was then produced by hydrolyzing the aluminum dodeoxide by means of a method described in U.S. Pat. No. 4,202,870. Then, water was added to this alumina slurry until the content of the solid of the aluminum hydrate reached 7.9%. The pH of the alumina slurry to which water was added was 9.5. By conditioning the pH with adding 3.9% nitric acid solution to this slurry, colloidal sol was obtained after one-week cure. The aluminum hydrate "a" shown in Table 1 was obtained by spray drying of this colloidal sol at 75° C. With using similar treatment to obtain the aluminum hydrate "a", except for having conducted one-month cure, aluminum hydrate "b" was obtained. The BET specific surface areas and pore volumes of these aluminum hydrates were obtained by means of the following methods:

1) Pore volume (PV): It was measured after degassing treatment at 120° C. for 24 hours with using Autosorp I (product name), made by Quanthachrome Co., by means of a nitrogen adsorption-desorption method.
2) BET specific surface area (SA): It was obtained by performing calculation with using the method of Brunauer et al.

TABLE 1

| Aluminum hydrate | a | b |
|---|---|---|
| BET specific surface are ($m^2/g$) | 185 | 75 |
| Pore volume (ml/g) | 0.51 | 0.72 |

(Production of Polyurethane Emulsion)

Polyurethane Emulsion A

After stirring 125.00 parts of polyester polyol (compound containing active hydrogen groups), which contains adipic acid, neopentylglycol, and 1,6-hexanglycol and has a molecular weight of 2000; 71.50 parts of 1,3-bis(1-isocyanate-1-methylethyl)benzene (compound with isocyanatge groups); and 90 parts of aceton at 45° C. for 6 hours under a nitrogen atmosphere, urethane prepolymers were produced by adding 22.51 parts of triethylamine thereinto. Next, by performing an elongation reaction and emulsification through droping the urethane prepolymers into an aqueous solution composed of 537.00 parts of water and 11.75 parts of γ-(2-aminoethyl) aminopropyltrimethoxysilane (compound with silicon groups), urethane emulsion A was synthesized. An average particle diameter of the emulsions obtained by the following method is shown in Table 2.

In addition, the urethane emulsion A was coated on a transparent polyester film so that the thickness after drying should be 5 μm, and was dried at 100° C. for 10 minutes. Although this coated film was immersed in water for two weeks to be observed, whitening could not be found and introduction of active silicon was confirmed.

Polyurethane Emulsions B to G

Polyurethane emulsions B to G were synthesized in the same conditions as those in the production of the polyurethane emulsion A except changing the dosage of γ-(2-aminoethyl)aminopropyltrimethoxysilane and the additive rate of silicon (rate of active hydrogen groups of the compound with silicon groups to isocyanate groups in the polyurethane emulsion). Average particle diameters of the emulsions that were obtained by the following method are shown in Table 2.

In addition, the urethane emulsions B to G were coated on transparent polyester films so that the thickness after drying should be 5 μm, and were dried at 100° C. for 10 minutes. These coated films were immersed in water for two weeks to be observed, and the results are shown in Table 2.

TABLE 2

| Polyurethane emulsion | A | B | C | D | E | F | G |
|---|---|---|---|---|---|---|---|
| Amount of γ-(2-aminoethyl)amino-propyltrimethoxysilane (g) | 11.75 | 2.94 | 0 | 47.00 | 58.76 | 11.75 | 11.75 |
| Rate of silicon added | 0.2 | 0.05 | 0 | 0.8 | 1 | 0.2 | 0.2 |
| Average particle diameter of emulsions (nm) | 75 | 80 | 93 | 70 | 65 | 18 | 115 |
| Coated surface after immersion test | ○ | Δ | x | ○ | ○ | ○ | ○ |

(○: No change, Δ: Slightly whitened, ×: Whitened)

Note: Average particle diameter: With measuring a particle diameter distribution with using CHDF-1100 particle diameter measuring instrument (product name) made by MATEC APPLIED SCIENCES Corp., an average particle diameter was calculated.

EXAMPLE 1

100 parts by weight of the aluminum hydrate "a" was added to the mixed solvent of ion-exchanged water and IPA (weight ratio of 8:2), the dispersed liquid was stirred for 120 minutes at the rotation speed of 1450 rpm with a disperser (Manufacturer: Satake Chemical Machinery Industry Co., Limited, Product name: Portable mixer A510, Blade: DS impeller blade).

Next, with stirring the dispersing liquid, 2% aqueous solution (the pH of this solution was conditioned at 4 with acetic acid to dissolve trimethoxysilane) containing 0.82 parts by weight of methyl trimethoxysilane (Manufacturer: Toshiba Silicone Co., Limited, Model: TSL-8113, Minimum coated area: 575 $m^2/g$) was added to the dispersed liquid.

Furthermore, the polyurethane emulsion A was added so that the weight ratio of solid components to aluminum hydrate (P/B) might be 10/1, and the coating liquid was conditioned by stirring it at a rotation speed of 1200 rpm for 30 minutes with using the disperser.

The recording medium 1 was obtained by performing kiss coating of the coating liquid at a coating speed of 10 m/minute with performing corona discharge on a transparent polyester film (TP), thereafter drying the TP at 115° C. to form an ink receiving layer at the coating thickness after drying of 35 μm.

The various characteristics of the recording medium thus obtained were evaluated with the method described later. The results are shown in Table 2.

EXAMPLES 2 TO 6

Printing media 2 to 6 were obtained in the same conditions as those of the example 1 except changing the amount of the urethane emulsion and coupling agent (coverage of the surface of the aluminum hydrate), which were used in the example 1, as shown in Table 2. The evaluation results are shown in Table 3.

Comparative Examples 1 to 3

Printing media 7 to 9 were obtained in the same conditions as those of the example 1 except changing the dosage of the urethane emulsion and coupling agent coverage of the surface of the aluminum hydrate, which were used in the example 1, as shown in Table 2. In addition, in the comparative examples 2 and 3, a coupling agent was not added.

The evaluation results are shown in Table 3.

TABLE 3

| | Example | | | | | | Comparative example | | |
|---|---|---|---|---|---|---|---|---|---|
| | 1 | 2 | 3 | 4 | 5 | 6 | 1 | 2 | 3 |
| No. of recording medium | 1 | 2 | 3 | 4 | 5 | 6 | 7 | 8 | 9 |
| Aluminum hydrate | a | a | a | a | a | b | a | a | b |
| Polyurethane emulsion | A | A | B | F | G | A | C | D | E |
| Coverage of Aluminum hydrate (%) | 2 | 0.5 | 0.1 | 2 | 2 | 2 | 45 | 0 | 0 |
| Coefficient of moisture absorption (%) | 0.7 | 0.9 | 2.0 | 0.6 | 0.8 | 0.9 | 2.8 | 3.2 | — |
| Condition of Dispersion of coating liquid | ◎ | ◎ | ◎ | ◎ | ◎ | ◎ | ◎ | ○ | x (gelation) |
| Initial characteristic in printing | | | | | | | | | |
| Smear | ◎ | ◎ | ◎ | ○ | ◎ | ◎ | Δ | ◎ | ◎ |
| Beading | ◎ | ◎ | ◎ | ○ | ◎ | ◎ | Δ | ◎ | ◎ |
| Waterproof | ◎ | ◎ | ◎ | ◎ | ◎ | ◎ | ◎ | ◎ | ◎ |
| Characteristic in printing after storage under high-temperature and high-humidity environment | | | | | | | | | |
| Smear | ◎ | ◎ | ○ | ○ | ◎ | ◎ | Δ | Δ | — |
| Beading | ◎ | ◎ | ○ | ○ | ◎ | ◎ | Δ | Δ | — |
| Haze | 1.4 | 1.4 | 2 | 1.1 | 15.8 | 6.8 | 2.5 | 1.2 | — |

The above evaluation method will be described below.

1) Condition of dispersion

This item was evaluated by visual inspection.

◎: Good no gelation and insoluble matter

○: Good, but highly viscous

×: Poor due to gelation or an insoluble matter

2) Initial characteristic in printing

This item was evaluated by visual inspection in regard to the smear and beading on a surface of the recording medium after whole surface printing in a single color or multiple colors from among Y, M, C, and Bk ink, which has the following composition, with using an ink jet printer. The ink jet printer comprised four drop-on-demand type ink jet heads for Y, M, C, and Bk colors each of which had 128 nozzles at the nozzle intervals of 16 nozzles/mm. Incidentally, this evaluation was carried out under ordinary temperature and humidity (23° C./60% RH), and the recording media that had been just produced were used.

It is assumed that the ink quantity in the single color printing is 100%.

◎: No smear and beading at the ink quantity of 300%

○: No smear and beading were observed at the ink quantity of 200%, while they were observed at the ink quantity of 300%

Δ: No smear and beading were observed at the ink quantity of 100%, while they were observed at the ink quantity of 200%

Ink composition:

| | |
|---|---|
| Ink dyes (Y, M, C, and Bk) | 5 parts each |
| Ethylene glycol | 10 parts |
| Polyethylene glycol | 10 parts |
| Water | 75 parts |

Ink dyes:

Y: C. I. direct yellow 86

M: C. I. ashed red 35

C: C. I. direct blue 199

Bk: C. I.. food black 2

3) Waterproof

After performing whole surface printing for a recording medium in a single color with the ink M having the above-described composition, immersing the recording medium in running water for 3 minutes, and air-drying the recording medium; waterproof was obtained by the following formula. Incidentally, this evaluation was performed under ordinary temperature and humidity (23° C./60% RH), and the printing media that had been just produced were used.

Waterproof (%)=(Image density after immersion in running water/Image density before immersion in running water)×100

◎: Waterproof value≧95%

○: 95%>Waterproof value≧88%

Δ: 88%>Waterproof value

Since waterproof of the ink M was the lowest among four colors in any examples, this ink M was selected as an evaluation object.

4) Printing characteristic after storage under high-temperature and high-humidity environment After leaving each recording medium, which was produced, under a high-temperature and high-humidity (50° C./80% RH) environment for 10 days, whole surface printing for the recording medium was performed in a single color or multiple colors from among ink Y, M, C, and Bk having the above-described composition. The smear and beading on a surface of the recording medium that was printed were evaluated by visual inspection.

It is assumed that the ink quantity in the single color printing is 100%.

◎: No smear and beading at the ink quantity of 300%

○: No smear and beading were observed at the ink quantity of 200%, while they were observed at the ink quantity of 300%

Δ: No smear and beading were observed at the ink quantity of 100%, while they were observed at the ink quantity of 200%

5) Haze

According to JISK-7105 (one of Japanese Industrial Standards), haze was measured with using a haze meter (Manufacturer: Nihon Denshoku Co., Limited, Model: NDH-1001DP).

6) Coefficient of moisture absorption

A sheet that had been just produced was cut in predetermined size and weighed (X g). After leaving this recording medium under a high-temperature and high-humidity (50° C./80% RH) environment for 10 days, picking up the recording medium, leaving the recording medium under a normal temperature and humidity (23° C./60%) for 30 minutes, and weighing the recording medium (Y g); the rate of moisture absorption of the ink receiving layer was obtained from the following formula:

Rate of moisture absorption (%)=$(Y-X)/(X-\text{Weight of base material})\times 100$ (%)

As described above, the present invention provides a recording medium having excellent shelf life and ink absorptivity under a high-humidity environment, wherein its ink receiving layer has transparency, image density is high, hue is clear, and resolution of an image is good, and provides an image formation method using the recording medium.

What is claimed is:

1. A recording medium having an ink receiving layer provided on its base material, wherein the ink receiving layer is obtained by coating the base material with dispersed liquid containing aluminum hydrate, a coupling agent having at least two hydrolyzable groups, and a urethane resin emulsion having hydrolyzable groups expressed by the following general formula (1):

$$—MR_n(OR')_{3-n} \quad (1)$$

where R and R' represent hydrogen or alkyl groups, which may be either identical or different; n represents an integer from 0 to 2; and M represents Si; and the ratio of silicon added is within a range of 0.1 to 0.8, and wherein the average particle diameter of the particles of the urethane resin emulsion is within a range of 20 to 100 nm.

2. The recording medium according to claim 1, wherein the rate of moisture absorption of the ink receiving layer is 2.0% or less.

3. The recording medium according to claim 1, wherein the BET specific surface area of the aluminum hydrate is within a range of 40 to 500 $m^2/g$.

4. The recording medium according to claim 1, wherein the pore volume of the aluminum hydrate is within a range of 0.1 to 1.0 ml/g.

5. The recording medium according to claim 1, wherein the pore volume of the ink receiving layer is within a range of 0.1 to 1.0 ml/g.

6. The recording medium according to claim 1, wherein the BET specific surface area of the ink receiving layer is within a range of 40 to 450 $m^2/g$.

7. An image formation method for forming an image by ejecting ink from micropores to attach the ink on a recording medium, wherein the image formation method uses the recording medium according to any one of claims 1 to 6 as the recording medium.

8. The image formation method according to claim 7, wherein the image formation method has a step of ejecting the ink by applying thermal energy to the ink.

9. A production method of a recording medium that is produced by forming an ink receiving layer on its base material, wherein the ink receiving layer is formed by coating the base material with dispersed liquid containing aluminum hydrate, a coupling agent having at least two hydrolyzable groups, and a urethane resin emulsion having hydrolyzable groups expressed by the following general formula (1) as a binder resin:

$$—MR_n(OR')_{3-n} \quad (1)$$

where R and R' represent hydrogen or alkyl groups, which may be either identical or different; n represents an integer from 0 to 2; and M represents Si; and the ratio of silicon added is within a range of 0.1 to 0.8, and wherein the average particle diameter of the particles of the urethane resin emulsion is within a range of 20 to 100 nm, and thereafter drying the recording medium.

10. The production method of a recording medium according to claim 9, wherein the BET specific surface area of the aluminum hydrate is within a range of 40 to 500 $m^2/g$.

11. The production method of a recording medium according to claim 9, wherein the pore volume of the aluminum hydrate is within a range of 0.1 to 1.0 ml/g.

* * * * *

UNITED STATES PATENT AND TRADEMARK OFFICE

CERTIFICATE OF CORRECTION

PATENT NO. : 6,500,525 B1 
DATED : December 31, 2002
INVENTOR(S) : Hiroyuki Ogino et al.

It is certified that error appears in the above-identified patent and that said Letters Patent is hereby corrected as shown below:

Column 1,
Line 53, "an" should read -- a --.

Column 2,
Line 29, "A object" should read -- An object --.

Column 3,
Line 57, "an silane" should read -- a silane --.

Column 7,
Line 25, "arbitrary" should read -- arbitrarily --.

Column 8,
Line 66, "A alumina" should read -- An alumina --.

Signed and Sealed this

Sixteenth Day of September, 2003

JAMES E. ROGAN
*Director of the United States Patent and Trademark Office*